US008864441B1

(12) United States Patent
Pinera

(10) Patent No.: US 8,864,441 B1
(45) Date of Patent: Oct. 21, 2014

(54) ROCKET ENGINE TURBOPUMP

(75) Inventor: Alex Pinera, Jupiter, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 738 days.

(21) Appl. No.: 13/205,858

(22) Filed: Aug. 9, 2011

Related U.S. Application Data

(60) Provisional application No. 61/489,388, filed on May 24, 2011.

(51) Int. Cl.
*F01D 1/02* (2006.01)

(52) U.S. Cl.
USPC ..... 415/105; 415/112; 415/229

(58) Field of Classification Search
USPC ..... 415/104, 105, 106, 111, 112, 175, 229, 415/231; 60/257, 259
See application file for complete search history.

(56) References Cited

U.S. PATENT DOCUMENTS

| | | | | |
|---|---|---|---|---|
| 5,209,652 | A * | 5/1993 | Fischer et al. | 417/409 |
| 8,622,690 | B1 * | 1/2014 | Wall | 415/105 |
| 2008/0014081 | A1 * | 1/2008 | Erler et al. | 415/199.1 |

* cited by examiner

*Primary Examiner* — Edward Look
*Assistant Examiner* — Juan G Flores
(74) *Attorney, Agent, or Firm* — John Ryznic

(57) ABSTRACT

A rocket engine turbopump with a main rotor shaft supporting a liquid oxygen impeller on a forward end and a turbine on an aft end, and with a multiple stage liquid hydrogen impeller in-between. Two hydrostatic bearings support the main rotor shaft such that the liquid oxygen impeller and the turbine are both overhung. A balancing piston is used to balance the main rotor shaft in an axial direction. This structure allows for the main rotor shaft to be of such a large diameter that the turbopump is capable of operating at around 70,000 rpm that can produce a liquid hydrogen outlet pressure of around 4,000 psia in a turbopump having a diameter of less than 10 inches.

8 Claims, 6 Drawing Sheets

ROCKET ENGINE TURBOPUMP

CROSS-REFERENCE TO RELATED APPLICATIONS

This application claims the benefit to Provisional application 61/489,388 filed on May 24, 2011 and entitled ROCKET ENGINE TURBOPUMP.

GOVERNMENT LICENSE RIGHTS

None.

BACKGROUND OF THE INVENTION

1. Field of the Invention

The present invention relates generally to a turbopump, and more specifically to a rocket engine turbopump with high output pressure.

2. Description of the Related Art Including Information Disclosed Under 37 CFR 1.97 and 1.98

A turbopump is a turbine driven pump that comprises of two main components: a pump and a driving turbine, usually both mounted on the same shaft, or sometimes geared together. The purpose of a turbopump is to produce a high pressure fluid for feeding a combustion chamber or other use. A turbopump generally comprise one of two types of pumps: centrifugal pump, where the pumping is done by throwing fluid outward at high speed; or axial flow pump, where helical style blades progressively raise the pressure of a fluid.

Axial flow pumps have small diameters, but give relatively modest pressure increases. They are generally used to raise the pressure gradually in order to prevent cavitation of the centrifugal pump. Centrifugal pumps are far more powerful for high density fluids, but require physically large diameters for low density fluids. Turbopumps operate in much the same way as turbo units for vehicles. Higher fuel pressures allow fuel to be supplied to higher-pressure combustion chambers for higher performance engines.

Turbopumps have a reputation for being extremely hard to design to get optimum performance. Whereas a well-engineered and debugged pump can manage 70-90% efficiency, figures less than half that are not uncommon. Low efficiency may be acceptable in some applications, but in rocketry this is a severe problem. Turbopumps in rockets are important and problematic enough that launch vehicles using one have been caustically described as a 'turbopump with a rocket attached'—up to 55% of the total cost has been ascribed to this area. Common problems include: excessive flow from the high pressure rim back to the low pressure inlet along the gap between the casing of the pump and the rotor; excessive recirculation of the fluid at inlet; excessive vortexing of the fluid as it leaves the casing of the pump; and, damaging cavitation to impeller blade surfaces in low (fluid) pressure zones. In addition, the precise shape of the rotor itself is critical.

BRIEF SUMMARY OF THE INVENTION

A rocket engine turbopump with a main rotor shaft supporting a liquid oxygen impeller on a forward end and a turbine on an aft end, and with a multiple stage liquid hydrogen impeller in-between. Two hydrostatic bearings support the main rotor shaft such that the liquid oxygen impeller and the turbine are both overhung. A balancing piston is used to balance the main rotor shaft in an axial direction. This structure allows for the main rotor shaft to be of such a large diameter that the turbopump is capable of operating at around 70,000 rpm that can produce a liquid hydrogen outlet pressure of around 4,000 psia in a turbopump having a diameter of less than 10 inches.

The turbopump of the present invention includes three stages for the liquid hydrogen propellant in order to produce the very high pressure; makes use of hydrostatic bearings that can be used at high rotational speeds to produce the very high discharge pressure; uses only one rotor shaft for the fuel and oxidizer propellant pumps and the turbine. The liquid oxygen (or LOX) pump on the turbopump is supported on an overhung shaft that does not need a bearing. The turbine that drives the liquid fuel and liquid oxygen pumps is also supported on an overhung rotor shaft and the housing is thermally isolated from the fuel pump (liquid Hydrogen).

The turbopump is capable of operating at around 70,000 rpm that can produce a liquid hydrogen outlet pressure of around 4,000 psia in a turbopump having a diameter of less than 10 inches. The turbopump includes a main rotor shaft 11 rotatably supported by two hydrostatic bearings with a forward hydrostatic bearing 12 and an aft hydrostatic bearing 13. For pressurizing the liquid hydrogen, a four stage pump is used with one axial inducer and three centrifugal impellers. The LOX or liquid oxygen impeller 41 is rotatably connected to the main rotor shaft 11 on a forward side of the forward hydrostatic bearing 12 and is overhung so that the LOX impeller is supported by the forward hydrostatic bearing 12. An inter-propellant seal assembly 47 is used to prevent mixture of the liquid oxygen and the liquid hydrogen and is in-between the LOX impeller and forward hydrostatic bearing 12.

DETAILED DESCRIPTION OF THE INVENTION

A turbopump for a rocket engine in which the turbopump has a very high discharge pressure. For an upper stage rocket engine of a rocket launch vehicle, a short nozzle is desirable in order to save space and weight. For a short nozzle, a very high chamber pressure is required. The turbopump of the present invention includes three stages for the liquid hydrogen propellant in order to produce the very high pressure. The P&W RL-10 rocket engine has a low chamber pressure of around 600 psi and requires a large extendable nozzle because of this.

One way of providing for a very high turbopump discharge pressure is to provide for a rotor shaft with very high rotational speed. However, typical turbopump rotor shafts are supported by bearings with rolling elements. Rolling element bearings cannot withstand the high rotational speeds that would be required to produce the very high discharge pressure. Thus, the turbopump of the present invention makes use of hydrostatic bearings that can be used at high rotational speeds to produce the very high discharge pressure. Because of the high rotational speed of the rotor shaft, and because of vibration issues due to rotor dynamics at this high rotor shaft speed, the rotor shaft of the turbopump has a relatively large diameter (compared to prior art rocket engine turbopumps) so as to prevent a bending mode. Also, because of the use of the hydrostatic bearings, a balancing piston is required for the turbopump. The turbopump of the present invention uses only one rotor shaft for the fuel and oxidizer propellant pumps and the turbine.

The liquid oxygen (or LOX) pump on the turbopump is supported on an overhung shaft that does not need a bearing. Rolling element bearings can cause a fire around the LOX pump because the metal material is actually a fuel for liquid oxygen. A spark or heat source may start the material burning. Also, the overhung rotor shaft for the LOX pump would allow for an axial pump for the liquid oxygen which aids with suction performance.

The turbine that drives the liquid fuel and liquid oxygen pumps is also supported on an overhung rotor shaft and the housing is thermally isolated from the fuel pump (liquid Hydrogen).

Figure 1:
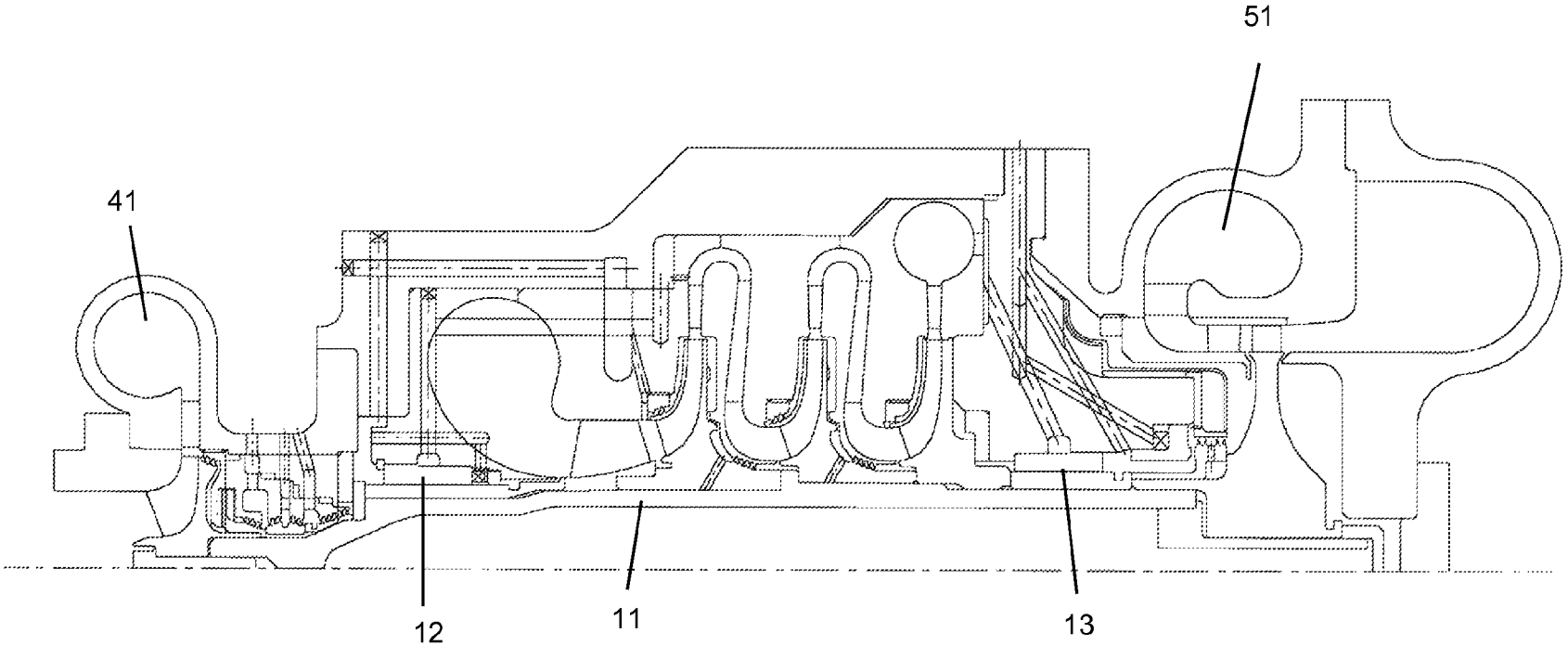
FIG. 1 shows a cross section view of the turbopump of the present invention.

FIG. 1 shows the turbopump for a rocket engine of the present invention. With this design, the turbopump is capable of operating at around 70,000 rpm that can produce a liquid hydrogen outlet pressure of around 4,000 psia in a turbopump having a diameter of less than 10 inches. The LOX outlet pressure is also around 4,000 psia. The turbine has an inlet pressure of around 3,300 psia and an outlet pressure of around 2,200 psia. The overall length of the turbopump is just over 17 inches.

The turbopump includes a main rotor shaft 11 rotatably supported by two hydrostatic bearings with a forward hydrostatic bearing 12 and an aft hydrostatic bearing 13. For pressurizing the liquid hydrogen, a four stage pump is used with one axial inducer and three centrifugal impellers. The inducer is used to increase the pressure to the first stage impeller while allowing the pump to operate with a low inlet pressure. A first stage centrifugal impeller 21 is located after the inducer near the forward hydrostatic bearing 12, a second stage centrifugal impeller 22 is located aft of the first centrifugal impeller 21, and a third stage centrifugal impeller 23 is located near to the aft hydrostatic bearing 13. The inducer and three centrifugal impellers 21-23 are connected in series so that the outlet of an upstream inducer/impeller flows into the inlet of the downstream impeller.

The LOX or liquid oxygen impeller 41 is rotatably connected to the main rotor shaft 11 on a forward side of the forward hydrostatic bearing 12 and is overhung so that the LOX impeller is supported by the forward hydrostatic bearing 12. The LOX pump is also a centrifugal impeller with an axial inlet and a radial outlet that discharges into a volute through a diffuser.

The turbine 51 that is used to drive the main rotor shaft 11 is rotatably connected to the aft end of the rotor shaft and is also overhung so that the aft hydrostatic bearing 13 also supports the turbine 51. The turbine includes a row of stator vanes that guide the hot gas stream into a row of rotor blades connected to the turbine rotor disk that drives the main rotor shaft 11.

Figure 2:
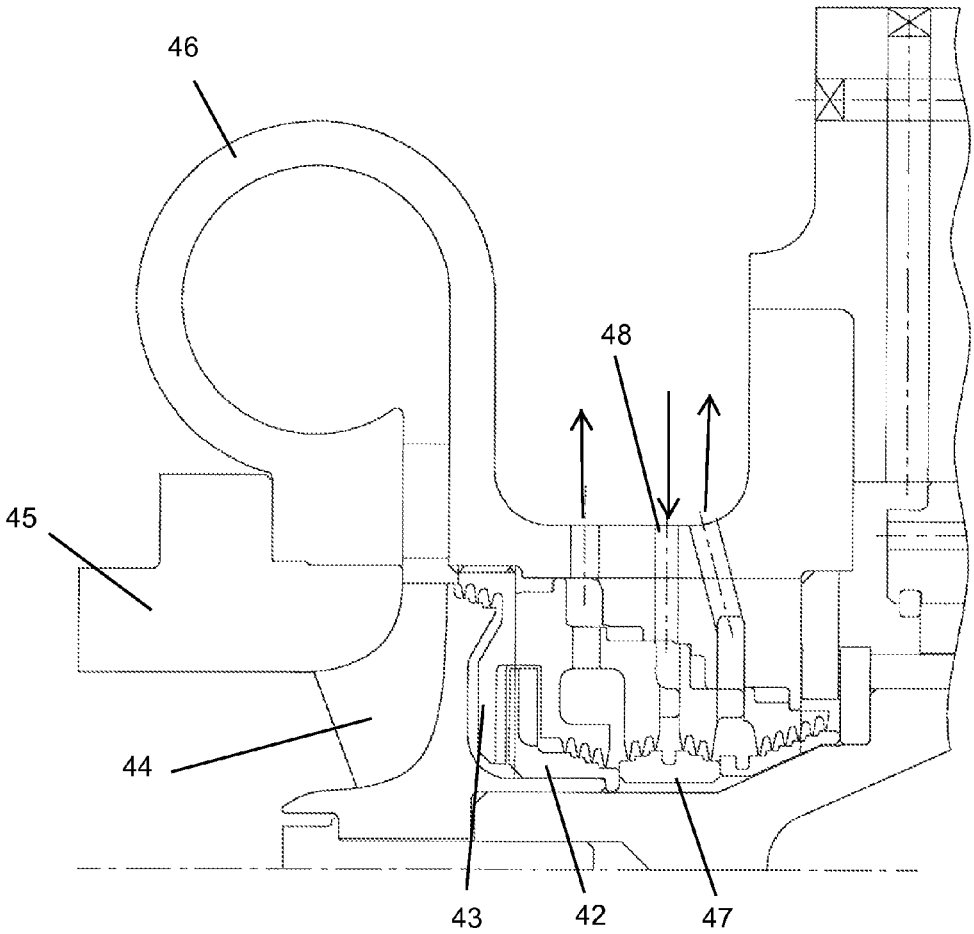
FIG. 2 shows a cross section view of the liquid oxygen pump of the turbopump of FIG. 1.
Figure 3:
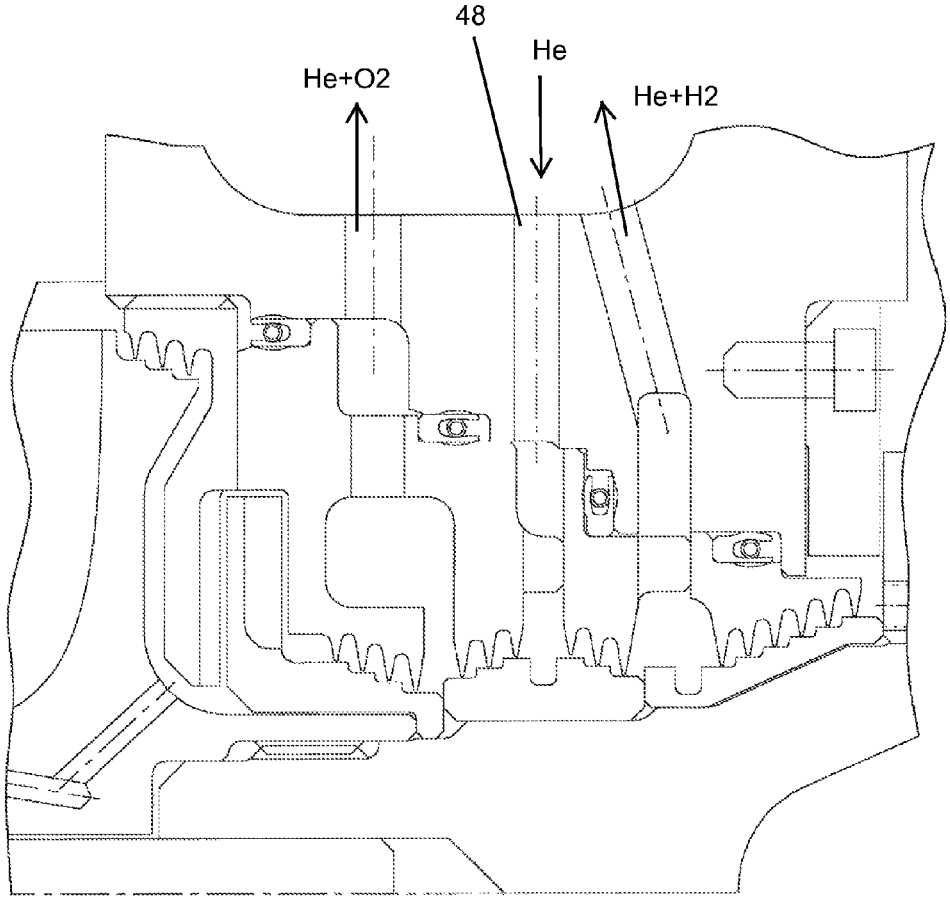
FIG. 3 shows a cross section view of the inter-propellant seal in the turbopump of the present invention.

FIG. 2 shows a more detailed view of the LOX impeller and housing with a LOX vaporizer 42, a hub and seal 43, a LOX pump impeller 44, a LOX pump inlet housing 45, and a LOX pump housing 46. An inter-propellant seal assembly 47 is used to prevent mixture of the liquid oxygen and the liquid hydrogen and is in-between the LOX impeller and forward hydrostatic bearing 12. An inert gas such as helium enters the radial passage 48 in the middle of the three radial passages in the inter-propellant seal 47 and helium and oxygen is discharged from the radial passage on the left while helium and hydrogen is discharged from the radial passage on the right side of the middle radial passage. A boost turbopump (not shown) is used to supply liquid oxygen at higher pressure to the LOX pump inlet housing 45. FIG. 3 shows a detailed view of the inter-propellant seal with the helium purge gas inlet and the two outlets for the hydrogen and oxygen gases. Labyrinth seals are used for sealing the three chambers that are part of the inter-propellant seal.

Figure 4:
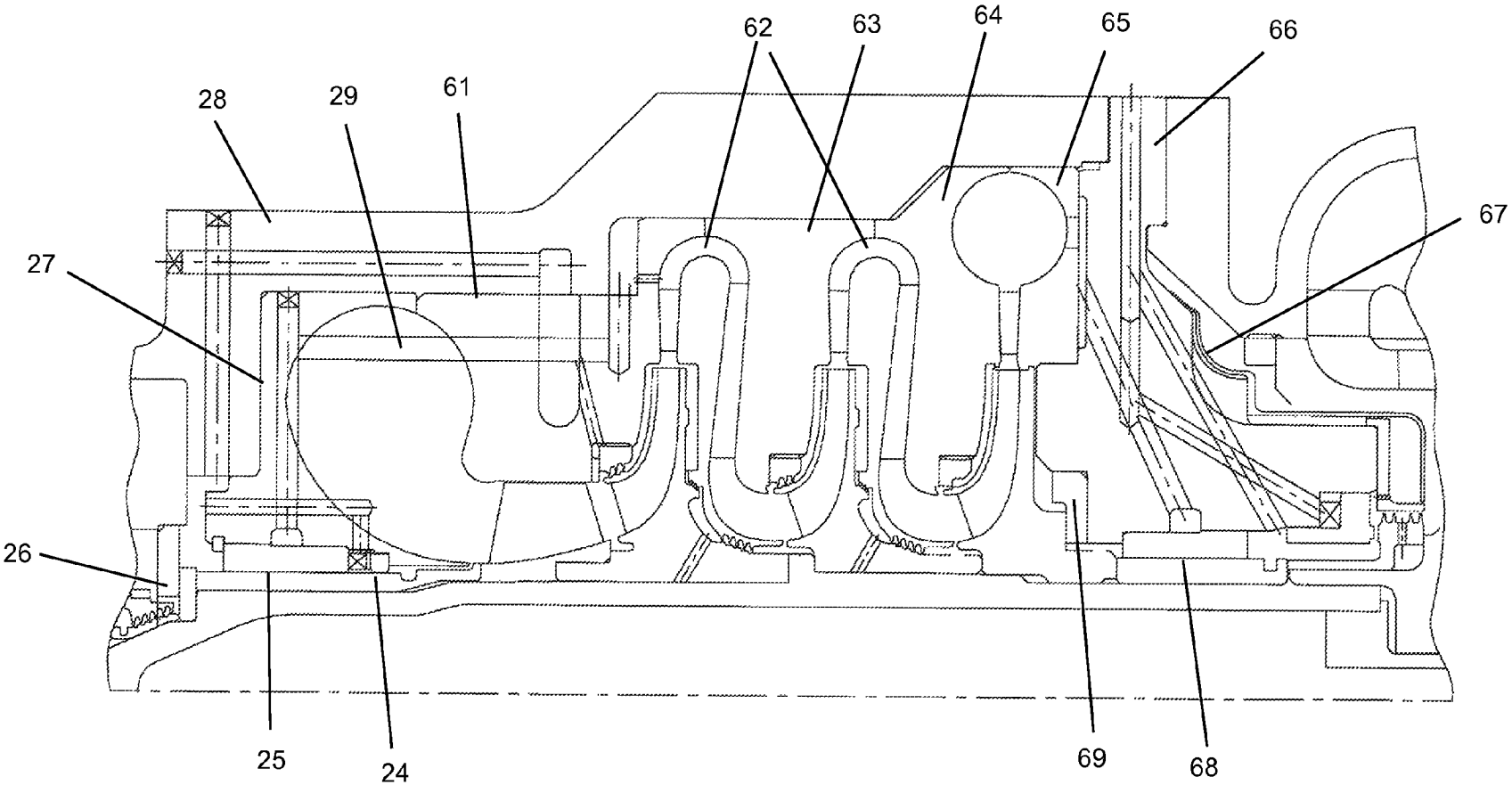
FIG. 4 shows a cross section view of the liquid hydrogen pump of the turbopump of FIG. 1.

FIG. 4 shows a more detailed view of the three stage liquid hydrogen pump with a floating ring carbon seal 24, a pump end journal bearing 25, a forward axial displacement limiter (ADL) 26, a liquid hydrogen inlet housing forward half 27, a main housing 28, a pump end journal bearing flow jumper tube 29, a liquid hydrogen inlet housing aft half 61, two crossover channels 62 that connect impellers 21 and 22 outlets to impellers 22 and 23 inlets, a crossover housing 63, a volute forward half 64 and a volute aft half 65, a liquid hydrogen pump closeout housing 66, a heat shield 67, a turbine end journal bearing 68, and an aft axial displacement limiter 69.

Figure 6:
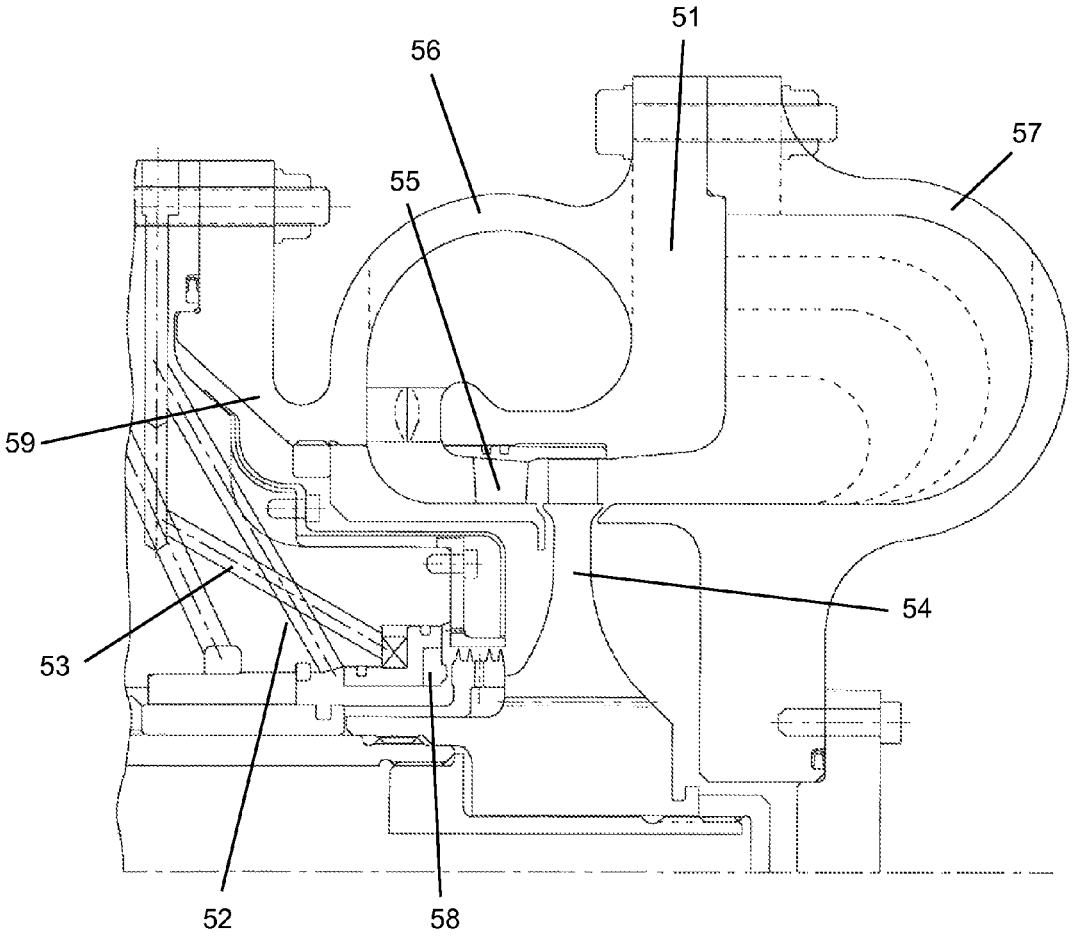
FIG. 6 shows a cross section view of the turbine of the turbopump of FIG. 1.

FIG. 6 shows a more detailed view of the turbine 51 with a chill-in vent 52, a lift-off seal vent 53, a turbine blisk 54, a turbine vane 55, a turbine inlet torus 56, a turbine exhaust manifold 57 (which can be a volute or a tangential discharge collector), and a lift-off seal 58. The turbine 51 includes a thin expansion ligament 59 that forms thermal isolation against the much cooler liquid hydrogen pump housing where the heat from the turbine flows along this section to the contact section between the liquid hydrogen pump and the turbine where the bolts are fastened.

Figure 5:
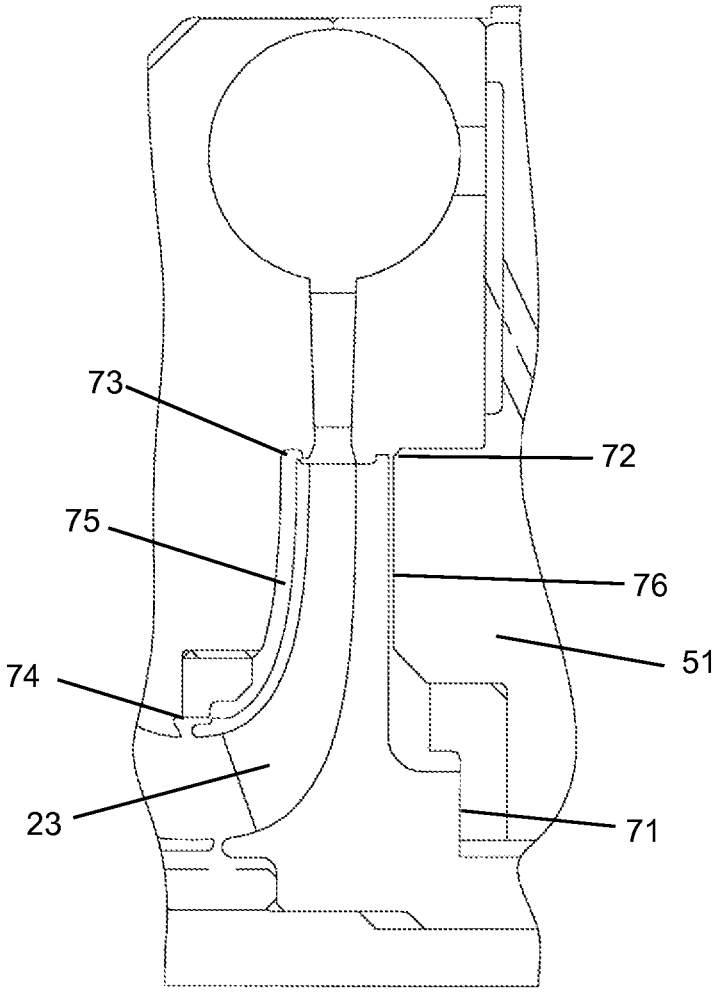
FIG. 5 shows a cross section view of the balancing piston of the turbopump of FIG. 1.

Because of the use of the hydrostatic bearings instead of rolling element bearings, a balance piston is required. FIG. 5 shows a detailed view of the third stage centrifugal pump 23 and a face seal 71 located between the turbine housing 51. An overlap face seal 72 is used and two corner seals with an outer corner seal 73 and an inner corner seal 74 around the centrifugal impeller blades. For the balance seal operation, in a forward rotor movement the inner corner seal 74 closes and the outer corner seal 73 opens to pressurize a forward cavity 75 of the centrifugal pump 23 while the overlap seal 72 closes and the face seal 71 opens to vent the aft cavity 76. For the aft rotor shaft movement, the opposite of the opening and closing of these seals occurs. The LOX impeller and the first and second stage fuel impellers are all inherently thrust balanced because the hub and shroud seals are at a similar radius. Two axial displacement limiting (ADL) devises are used to handle the start and shutdown transients when the balance piston is not yet effective due to insufficient pressures in the balance piston cavities. The forward ADL limits the rotor from moving too far forward and the aft ADL limits the rotor from moving too far aft. These ADLs are made of hard wear resistant materials to limit the amount of wear that occurs when two surfaces rub at high speed and contact pressure.

I claim the following:

1. A turbopump for a rocket engine comprising:

a main rotor shaft having a forward end and an aft end;

a liquid oxygen impeller rotatably connected to the forward end of the main rotor shaft;

a turbine rotatably connected to the aft end of the main rotor shaft;

a multiple stage liquid hydrogen impeller rotatably connected to the main rotor shaft between the liquid oxygen impeller and the turbine;

a forward side hydrostatic bearing located between the liquid oxygen impeller and the multiple stage liquid hydrogen impeller to rotatably support the forward side of the main rotor shaft;

an aft side hydrostatic bearing located between the multiple stage liquid hydrogen impeller and the turbine to rotatably support the aft side of the main rotor shaft; and, both of the liquid oxygen impeller and the turbine are formed as an overhung rotor shaft.

2. The turbopump of claim 1, and further comprising:

an inter-propellant seal located between the liquid oxygen impeller and the multiple stage liquid hydrogen impeller to prevent hydrogen and oxygen from mixing together.

3. The turbopump of claim 1, and further comprising:

the turbine includes a thin expansion ligament that forms thermal isolation against the liquid hydrogen impeller.

4. The turbopump of claim 1, and further comprising:

the multiple stage liquid hydrogen impeller includes an inducer and three centrifugal impellers connected in series.

5. The turbopump of claim 1, and further comprising:

a forward axial displacement limiter and an aft axial displacement limiter to handle start and shutdown transients when a balance piston is not yet effective due to insufficient pressures in balance piston cavities.

6. The turbopump of claim 1, and further comprising:

a balancing piston to balance the main rotor shaft in an axial direction.

7. The turbopump of claim 6, and further comprising:

the balancing piston is formed as part of the last stage liquid hydrogen impeller and includes a forward cavity and an aft cavity around the impeller.

8. The turbopump of claim 6, and further comprising:

the main rotor shaft is of such a large diameter that the turbopump is capable of operating at around 70,000 rpm that can produce a liquid hydrogen outlet pressure of around 4,000 psia in a turbopump having a diameter of less than 10 inches.

* * * * *